US007946725B2

(12) United States Patent
Waffenschmidt et al.

(10) Patent No.: US 7,946,725 B2
(45) **Date of Patent: *May 24, 2011**

(54) METHOD AND DEVICE FOR GROUPING AT LEAST THREE LAMPS

(75) Inventors: Eberhard Waffenschmidt, Aachen (DE); Matthias Wendt, Wurselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 12/832,582

(22) Filed: Jul. 8, 2010

(65) Prior Publication Data

US 2010/0277080 A1 Nov. 4, 2010

Related U.S. Application Data

(63) Continuation of application No. 12/067,946, filed as application No. PCT/IB2006/053344 on Sep. 18, 2006, now Pat. No. 7,775,678.

(30) Foreign Application Priority Data

Sep. 26, 2005 (EP) ..... 05108851

(51) Int. Cl.
*F21V 33/00* (2006.01)

(52) U.S. Cl. ..... 362/234; 362/276; 362/802

(58) Field of Classification Search ..... 362/85, 362/234, 276, 802
See application file for complete search history.

(56) References Cited

U.S. PATENT DOCUMENTS

| | | | | |
|---|---|---|---|---|
| 6,241,364 | B1 | 6/2001 | Want et al. | |
| 7,598,859 | B2 * | 10/2009 | Laski et al. | 340/539.3 |
| 2004/0105264 | A1 | 6/2004 | Spero | |
| 2004/0122930 | A1 | 6/2004 | Pasternak | |
| 2005/0083697 | A1 | 4/2005 | Filep | |

FOREIGN PATENT DOCUMENTS

| | | | |
|---|---|---|---|
| WO | 2002013490 | A2 | 2/2002 |
| WO | 2004057927 | A1 | 7/2004 |
| WO | 2005096677 | A1 | 10/2005 |

* cited by examiner

*Primary Examiner* — John A Ward

(57) ABSTRACT

The invention relates to a method and a device for grouping at least three lamps (1) and for assigning the lamps (1) to at least one operating unit. It is time-intensive to equip one or a plurality of rooms or halls within a building with lamps (1), particularly a grouping of lamps (1), and assigning lamps (1) to at least one operating unit. Therefore, grouping of lamps (1) and assigning the lamps (1) to at least one operating unit should be simplified. In accordance with the invention, a lamp (1) emits light and the other lamps (1) measure light, and distances between the lamps (1) are determined in dependence upon at least one light value and the lamps (1) are assigned to at least one operating unit in dependence upon the distances.

5 Claims, 1 Drawing Sheet

METHOD AND DEVICE FOR GROUPING AT LEAST THREE LAMPS

Figure 1:
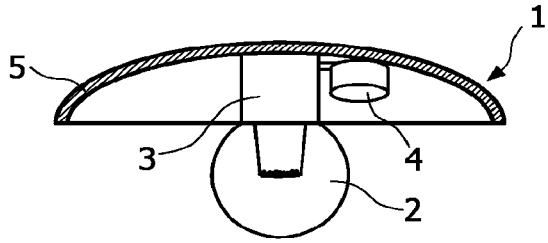

This application is a continuation of U.S. patent application Ser. No. 12/067,946, which is a national stage application under 35U.S.C. §371 of International Application No. PCT/IB2006/053344 filed on Sep. 18, 2006, which claims priority to European Application No. 05108851.6, filed on Sep. 26, 2005, incorporated herein by reference.

The invention relates to a method and a device for grouping at least three lamps, which comprise an illumination means, a lamp socket, a sensor and an identification and are connected to a power supply, and for assigning the lamps to at least one operating unit for switching lamps on and off by means of a control device.

Illumination devices comprising a control device are well known from US 2005/0083697 A1, which illumination devices are arranged on a rail and illuminate a target area. Sensors at the illumination devices measure rays, which are radiated by a transmitter arranged in the target area. If the rays are blocked by an object that moves between the target area and one of the illumination devices, the illumination unit controlled by the control device will move on the rail in such a manner that the target area remains free of shadows.

It is time-intensive to equip one or a plurality of rooms or halls within a building with lamps, particularly a grouping of lamps and assigning lamps to at least one operating unit.

WO 02/13490 A2 discloses a system and a method for the configuration of network devices. The method comprises acts of communicating a unique identifier from a network device to a remote receiver, communicating the unique identifier from the remote receiver to a controller, generating a network address and communicating the network address from the controller to the network device from which the unique identifier was originally communicated. A remote receiver receives signals from a light. Minimizing interference of a nearby light during communication the remote receiver has to be aligned to the light. The remote receiver has to be aligned to each light, to which communication takes place. The methods and systems may be usefully employed to reconfigure an existing lightning network when fixtures are added, removed, or replaced. As the topology of the lightning network changes, network addresses may be conveniently changed as well.

It is therefore an object of the invention to simplify the grouping of lamps and assigning the lamps to at least one operating unit, particularly a spatial arrangement of lamps should be ascertainable.

This object is achieved in accordance with the characteristic features of the independent claims. The method and the device are characterized in that the control device transmits a switch-on signal to a lamp for emitting light and to the other lamps for measuring light, in that one lamp emits light and the other lamps measure light, in that at least one other lamp transmits a response signal, which comprises a value of received light, in that in dependence on at least one light value the distances between the lamps are determined, in that in dependence on the distances the lamps are grouped and assigned to at least one operating unit. Depending upon boundary conditions, there are a plurality of possibilities for starting and implementing such a mode of grouping lamps and assigning the lamps to at least one operating unit. If a troublesome manual input of the identifications is omitted, the control device transmits a request signal. Lamps that have recognized the request signal respond by means of their identification. The identifications of the lamps define a temporal measure for a response. Lamps having a higher identification respond later than lamps having a lower identification within defined time intervals. Consequently, a serial response and hence one that is free of overlapping is guaranteed. After the control device has received the identifications of all the lamps involved, an arbitrary lamp is selected by the control device for emitting light. A switch-on signal is transmitted to the relevant lamp. This switch-on signal can be recognized by the other lamps as a signal to measure the ambient brightness, or, in other words, to measure receivable light by means of the sensors. After a defined unit of time, the other lamps respond in dependence upon their identification and transmit data which correspond to the received light. Alternatively, all the other lamps are queried individually with regard to the received light. The distances between the other lamps and the first lamp are determined in dependence upon the brightness measured. An estimate is sufficient. The more brightness received, the smaller the distance is. In a first approximation, a linear dependence is presupposed, because the actual distance in meters is not important, but merely the relative arrangement of the lamps to each other. Subsequently, the second lamp is triggered and the second lamp radiates light. The other lamps respond in dependence upon time, or upon request, with regard to the incoming light. If, in a further query mode, an already determined distance between two lamps is determined to be different, then an average value is obtained. Thus, a spatial arrangement of the lamps, also denoted as topology, can be determined. If a lamp does not receive light from another lamp, and vice versa, then these lamps do not see each other. If lamps do not see each other, this may be due to several reasons. The lamps are in at least two different rooms, in a multicornered room or arranged in a hall at a large distance from each other. Lamps, which actually see each other but not other lamps, are combined into one group and assigned to at least one operating unit. The operating unit has one or a plurality of identifications. In accordance with this assignment, a part of a room, a plurality of parts of a room or a room or a hall can be completely illuminated by means of the operating unit. Advantageously, one or a plurality of operating units have one or a plurality of switches, buttons, change-over switches or light-adjusting switches, also denoted as dimmers. Furthermore, one or a plurality of operating units can be construed as decentralized timers, motion detectors or remote controls, which transmit switch-on and switch-off signals via infrared, radio, light or ultrasonic waves. Before starting the query mode, also denoted as configuration process, the ambient brightness is measured with the lamps switched off in order to suppress an influence of the ambient brightness, i.e. of the light not generated by one or a plurality of the lamps. This measured value is then taken into consideration with the values calculated in further measurements, i.e. subtracted. It is advantageous to define a threshold value in order to implement such a query mode. If the room is influenced too much by daylight, so that there is a high ambient brightness, then the query mode is adjourned to another time. It is advantageous to implement these query modes in the darkness at night or at least during twilight. Alternatively, sunshades or shutters can be closed in order to create darkness artificially. Then the light measurement by means of the sensors remains uninfluenced by daylight. The daylight can be used for the purpose of identifying lamps that are arranged on the side of a window.

Simple light bulbs, fluorescent illumination means, compact fluorescent illumination means, halogen lamps and light-emitting diodes or LED for short can be used as illumination means. In lamps having color-variable illuminants, photo sensors are utilized in order to measure light brightness and color and to readjust the color-variable illuminants accordingly. Advantageously, these sensors can be used at the same time as sensors for detecting adjacent lamps. In order to determine a precise position, sensors can be advantageously focused, particularly on the region below the lamp, which is illuminated by the lamp light. Thus, an even more precise determination of the position of the lamp can be obtained.

Another alternative is placing a lamp having an identification at a defined location, transferring this identification and the location into the control device and starting a query mode. Then a request signal can be transmitted and lamps that recognize the request signal respond. It is useful if the manufacturer defines a set of lamps for a room or a building and thus predefines target identifications and response times. This lamp set is given a continuous numbering, so that a simple input of the start and end identification into the control device is possible. The control device then generates identifications lying in between these extremes.

A plurality of alternatives is available for communication between the control device, the lamps and the switches. In a first embodiment, the control device is connected to a power supply by means of a mains cable, which simultaneously supplies power to the lamps and the switches. Then control commands can be exchanged between the control device, the lamps and the switches via the electrically conductive cables of the power supply. This means that the electrically conductive cables are provided both for power supply and data exchange. This method is referred to as power line communication.

In a second embodiment, control commands can be wirelessly exchanged as broadcast signals between the control device, the lamps and the switches.

In a third embodiment, separate electrically conductive cables are arranged between the control device, the lamps and the switches, via which data exchange takes place.

In a fourth embodiment, the light of the illumination units can be modulated and data exchange takes place via the light modulation. Advantageously, this light modulation is not perceptible by the human eye.

Figure 2A:
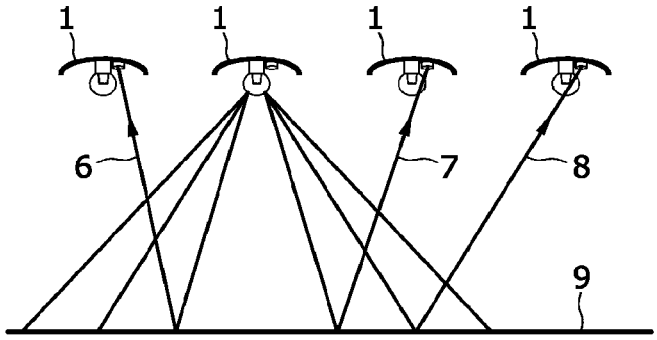
Figure 2B:
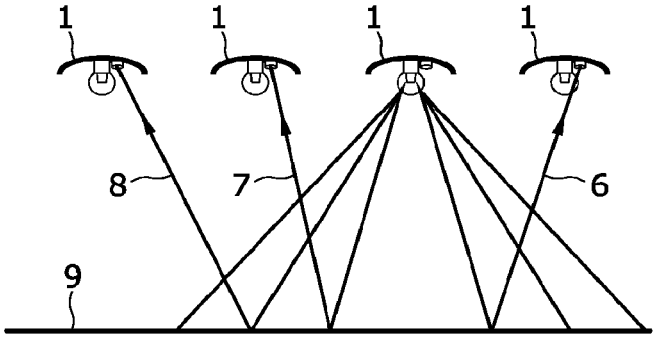
Figure 2C:
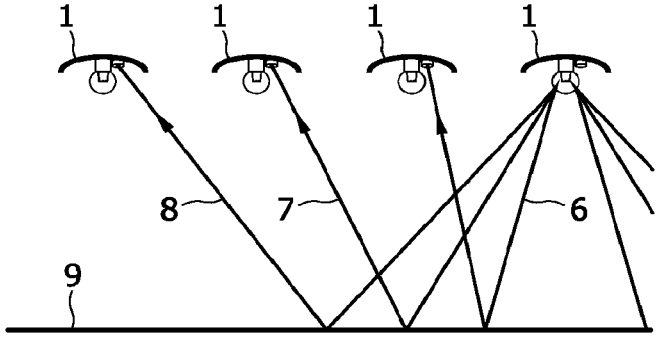

These and other aspects of the invention are apparent from and will be elucidated with reference to the embodiments described hereinafter In the drawings:

FIG. 1 shows a lamp with a socket, an illumination means and a sensor in a partially sectional side view, FIG. 2A is a schematic representation of an arrangement of four lamps, of which one lamp radiates light and the other three measure light that can be received, FIG. 2B is a schematic representation of the arrangement of four lamps, of which another lamp radiates light and the other three measure light that can be received, FIG. 2*c* is a schematic representation of the arrangement of four lamps, of which a third lamp radiates light and the other three measure light that can be received.

In the different Figures, similar or identical elements are denoted by the same reference symbols.

FIG. 1 shows a lamp 1 with an illumination means 2, a lamp socket 3, a sensor 4 and a reflector 5.

FIG. 2A shows four lamps 1 arranged in a row. The second lamp 1 from the left is switched on and radiates light beams 6, 7 and 8, which are reflected by the floor 9 and are received by sensors 4 of the adjacent lamps 1. The light beams 6 and 7 to the sensors 4 of directly adjacent lamps 1 cover a shorter distance than the light beam 8 to the sensor 4 of a more distant lamp 1 on the right-hand side. When impinging on the sensor 4, the light beams 6 and 7 covering the shorter distance have a higher intensity than the light beam 8 covering the longer distance. The sensors 4 of directly adjacent lamps 1 thus detect higher light values than the sensor 4 of the more distant lamp 1.

FIG. 2B also shows the four lamps 1 arranged in a row. The third lamp 1 from the left is switched on and radiates light beams 6, 7 and 8, which are reflected by the floor 9 and are received by sensors 4 of the adjacent lamps 1. The light beams 6 and 7 to the sensors 4 of directly adjacent lamps 1 cover a shorter distance than the light beam 8 to the sensor 4 of a more distant lamp 1 on the left-hand side. When impinging on the sensor 4, the light beams 6 and 7 covering a shorter distance have a higher intensity than the light beam 8 covering a longer distance. The sensors 4 of directly adjacent lamps 1 thus detect higher light values than the sensor 4 of the more distant lamp 1.

FIG. 2C also shows the four lamps 1 arranged in a row. The fourth lamp 1 from the left is switched on and radiates light beams 6, 7 and 8, which are reflected by the floor 9 and received by the sensors 4 of the adjacent lamps 1. A first lamp 1 is directly adjacent, a second lamp 1 is at a large distance from the light-radiating lamp 1 and a third lamp is at an even larger distance. The light beam 6 covers a long distance, the light beam 7 covers a longer distance and the light beam 8 covers an even longer distance. The intensity of the light beams 6, 7 and 8 decreases with the length of the distance covered and is consequently different when impinging on the sensor 4; a statement can thus be made about a topology of the lamps 1.

LIST OF REFERENCE NUMERALS

1 Lamp
2 Illumination means
3 Lamp socket
4 Sensor
5 Reflector
6 Light beam
7 Light beam
8 Light beam
9 Floor

The invention claimed is:

1. A device for grouping at least three lamps, comprising:
an illumination means,
a lamp socket,
at least one sensor configured to sense light and to generate response signals indicative of at least one value of the light; and
a control device having an identification and connected to a power supply, the control device assigning the lamps to at least one operating unit for switching the lamps on and off, wherein:
the at least three lamps are configured to emit light and measure light incident thereon;
the control device applies a switch-on signal to at least one lamp for emitting light and to the other lamps of the at least three lamps for measuring light,
at least one lamp of the light-measuring lamps supplies a response signal representing a value of the light received,
distances between the at least three lamps are determined based at least in part on the value, and
the lamps are grouped based at least in part on the determined distances and assigned to the at least one operating unit configured to receive the response signals from the lamps.

2. The device of claim 1, wherein the operating unit comprises a plurality of switches.

3. The device of claim 2, further comprising a plurality of electrically conductive cables arranged between the control device, the lamps and the plurality of switches.

4. The device of claim 1, wherein the control device communicates with the lamps via light modulation.

5. The device of claim 1, wherein the control device communicates with the lamps via the power supply.

* * * * *